US005502955A

United States Patent [19]

Chen

[11] Patent Number: 5,502,955

[45] Date of Patent: Apr. 2, 1996

[54] PACKING MACHINE

[76] Inventor: Hsu-ting Chen, No. 150-1, Kwangming 10th Lane, Weihsin Village, Yungan Hsiang, Kaohsiung Hsien, Taiwan

[21] Appl. No.: 427,207

[22] Filed: Apr. 24, 1995

[51] Int. Cl.[6] ..... B65B 09/06

[52] U.S. Cl. ..... 53/551; 53/550; 53/374.4

[58] Field of Search ..... 53/550, 551, 552, 53/553, 554, 374.3, 374.4

[56] References Cited

U.S. PATENT DOCUMENTS

| | | | |
|---|---|---|---|
| 2,385,229 | 9/1945 | Patterson | 53/551 |
| 2,951,325 | 9/1960 | Podlesak et al. | 53/550 |
| 3,992,854 | 11/1976 | Howell et al. | 53/551 |
| 4,466,228 | 8/1984 | Gess | 53/553 |
| 4,608,810 | 9/1986 | Bordini | 53/554 |
| 4,637,200 | 1/1987 | Shibata et al. | 53/554 |
| 4,691,499 | 9/1987 | Umeda et al. | 53/551 |
| 4,712,357 | 12/1987 | Crawford et al. | 53/550 |
| 5,079,902 | 1/1992 | Seko et al. | 53/553 |
| 5,279,098 | 1/1994 | Fukuda | 53/551 |

*Primary Examiner*—John Sipos
*Assistant Examiner*—Gene L. Kim
*Attorney, Agent, or Firm*—Poms, Smith, Lande & Rose

[57] ABSTRACT

A packing machine includes a frame on a bottom of which a motor is mounted which has a rotary shaft laterally protruding therefrom. A sprocket train is securely mounted around the rotary shaft of the motor to rotate therewith. A chain train is mounted in the frame for co-operating with the sprocket train. A first sealing module is mounted on the side portion of the frame and is driven by the chain train for coupling the two opposite edges of the plastic film together. A second sealing module is mounted on the side portion of the frame below the first sealing module and is driven by the chain train for sealing the bottom end of the plastic film. A guiding device is mounted on the side portion of the frame for introducing the plastic film to smoothly move through the first sealing module and the second sealing module. A supply device is mounted on the top portion of the frame and includes fluid material contained therein for supplying the fluid material into the plastic film whose two opposite edges and bottom end are respectively sealed by the first and second sealing modules.

2 Claims, 3 Drawing Sheets

PACKING MACHINE

BACKGROUND OF THE INVENTION

1. Field of Invention

The present invention relates to a packing machine, and more particularly to a packing machine suitable for use on a table.

2. Related Prior Art

A conventional packing machine has a large volume, thereby taking up much space and easily causing a great cost in manufacturing.

The present invention has arisen to mitigate and/or obviate disadvantages of the conventional packing machine.

SUMMARY OF THE INVENTION

The primary objective of the present invention is to provide a packing machine which occupies a small space and is suitable for use on a table.

In accordance with one aspect of the present invention, there is provided a packing machine for packing a plastic film which includes a top end, a bottom end and two opposite edges. The packing machine comprises a frame having a top portion, a bottom portion and a side portion. A motor is mounted on the bottom portion of the frame and includes a rotary shaft laterally protruding therefrom. A sprocket train is securely mounted around the rotary shaft of the motor to rotate therewith. A chain train is mounted in the frame for co-operating with the sprocket train.

A first sealing module is mounted on the side portion of the frame and is driven by the chain train for coupling the two opposite edges of the plastic film together. A second sealing module is mounted on the side portion of the frame below the first sealing module and is driven by the chain train for sealing the bottom end of the plastic film. A guiding device is mounted on the side portion of the frame for introducing the plastic film to smoothly move through the first sealing module and the second sealing module.

A supply device is mounted on the top portion of the frame and includes fluid material contained therein for supplying the fluid material into the plastic film whose two opposite edges and bottom end are respectively sealed by the first and second sealing modules.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
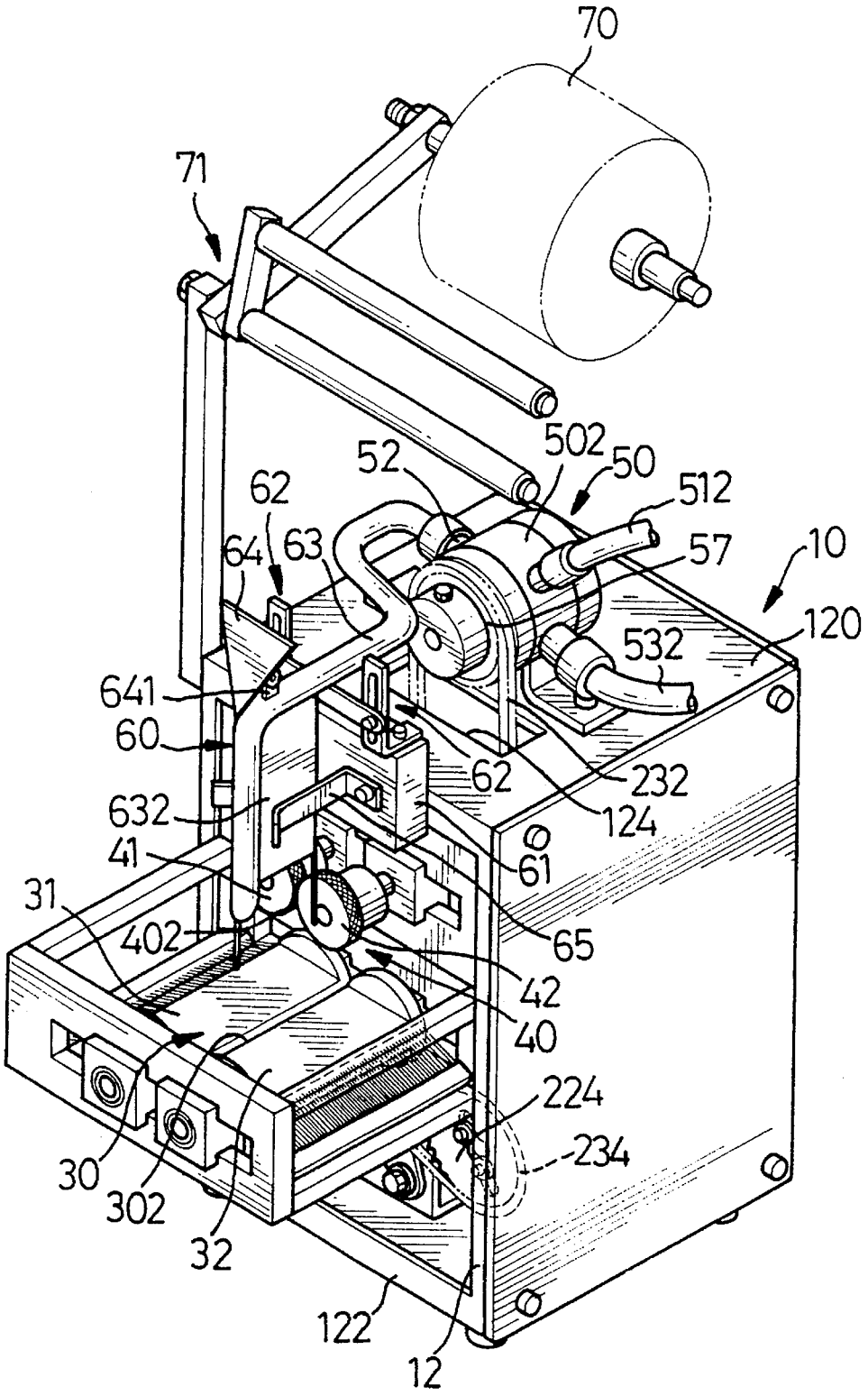
FIG. 1 is a perspective view of a packing machine in accordance with the present invention.
Figure 2:
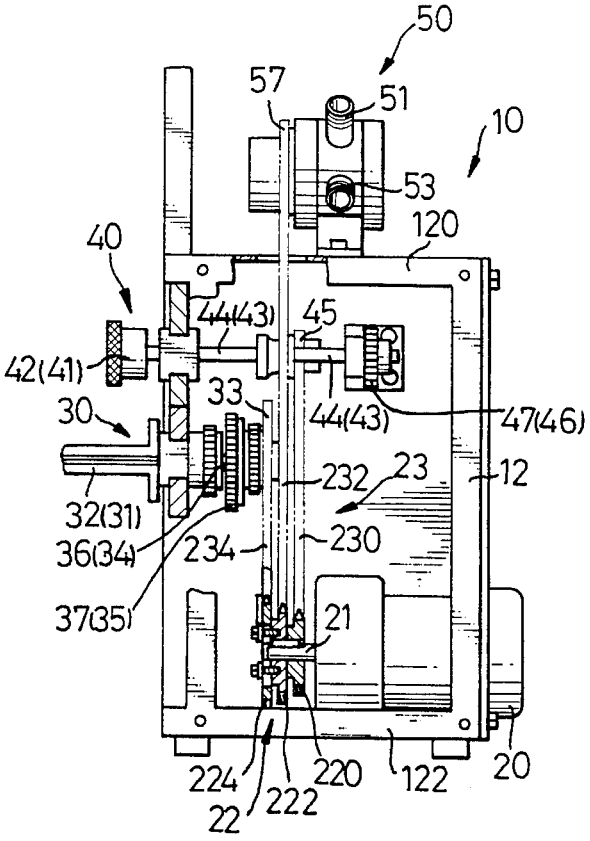
FIG. 2 is a right side cross-sectional view of FIG. 1.

Referring to the drawings, and initially to FIGS. 1–2, a packing machine 10 in accordance with the present invention is provided for sealing and packing a plastic film 72 (see FIG. 5) which includes a top end, a bottom end and two opposite edges. The packing machine 10 comprises a frame 12 having a top portion 120, a bottom portion 122 and a side portion (not numbered). A motor 20 is mounted on the bottom portion 122 of the frame 12 and includes a rotary shaft 21 laterally protruding therefrom. A sprocket train 22 is securely mounted around the rotary shaft 21 of the motor 20 to rotate therewith. A chain train 23 is mounted in the frame 12 for co-operating with the sprocket train 22.

A first sealing module 40 is mounted on the side portion of the frame 12 and is driven by the chain train 23 for coupling the two opposite edges of the plastic film 72 together. A second sealing module 30 is mounted on the side portion of the frame 12 below the first sealing module 40 and is driven by the chain train 23 for sealing the bottom end of the plastic film 72.

A guiding device 60 is mounted on the side portion of the frame 12 for introducing the plastic film 72 to smoothly move through the first sealing module 40 and the second sealing module 30. A supply device 50 is mounted on the top portion 120 of the frame 12 and includes fluid material or food (not shown) contained therein for supplying the fluid material into the plastic film 72 whose two opposite edges and bottom end are respectively sealed by the first and second sealing modules 40 and 30.

Figure 3:
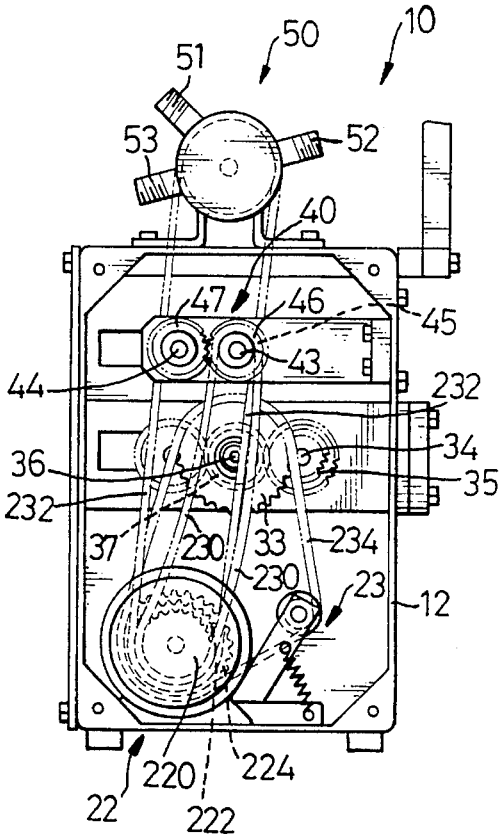
FIG. 3 is a rear side cross-sectional view of FIG. 1.
Figure 4:
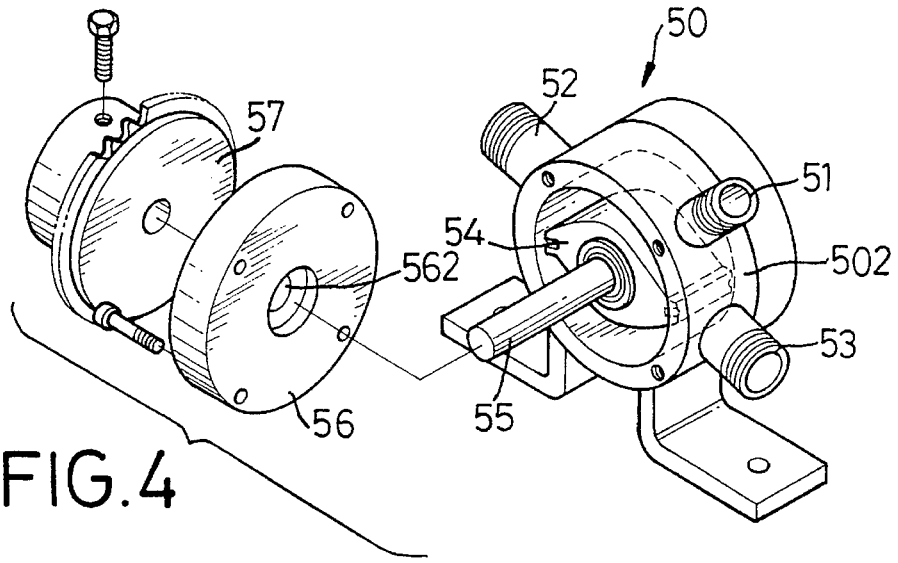
FIG. 4 is an enlarged exploded view of a supply device as shown in FIG. 1.

Referring to FIGS. 2 and 3 with reference to FIG. 1, the first sealing module 40 comprises a first axle 43 and a second axle 44 each respectively mounted through the side portion of the frame 12 and each having a first end and a second end. A first sealing roller 41 and a second sealing roller 42 are respectively mounted around the first end of the first and second axles 43 and 44 to rotate therewith. A first gear 46 and a second gear 47 mesh with each other and each are respectively mounted around the second end of the first and second axles 43 and 44 to rotate therewith. A sprocket 45 is fixedly mounted around a mediate portion of the first axle 43.

The second sealing module 30 comprises two adjacent elongated plates 31 and 32 protruding outwardly from the side portion of the frame 12. Two axles 34 and 36 each are respectively and fixedly mounted to the two elongated plates 31 and 32. Two gears 35 and 37 mesh with each other and each are respectively and fixedly mounted around the two axles 34 and 36. A sprocket 33 is fixedly mounted around the axle 36.

The sprocket train 22 comprises three sprockets 220, 222 and 224 each fixedly mounted around the rotary shaft 21 of the motor 20 to rotate therewith. The chain train 23 comprises a chain 230 meshing with the two sprockets 220 and 45 and a chain 234 meshing with the sprockets 224 and 33.

By such an arrangement, the sprockets 220 and 224 are rotated with the rotary shaft 21 by means of the motor 20, thereby respectively rotating the sprockets 45 and 33 via the chains 230 and 234 such that the two meshing gears 43 and 44 are rotated relative to each other and the two meshing gears 35 and 37 are rotated relative to each other, thereby in turn rotating the two axles 43 and 44 and the two axles 34 and 36 such that the first and second sealing rollers 41 and 42 are rotated relative to each other so as to seal and couple the two edges of the plastic film 72, and such that the two elongated plates 31 and 32 are rotated relative to each other.

Referring to FIGS. 1–4, the supply device 50 comprises a body 502 mounted on the top portion 120 of the frame 12. The body 502 includes an inlet portion 51, an outlet portion 52, and a circulating portion 53 each respectively formed on a periphery thereof and protruding outwardly therefrom. A cap 58 is securely mounted on the body 502 and a sprocket 57 is fixedly mounted on the cap 58. A rotary shaft 55 is rotatably mounted in a hole 562 defined through the cap 56 and includes a first end fixedly mounted in the sprocket 57 and a second end around which a blade 54 is fixedly mounted to rotate therewith.

A chain 232 of the chain train 23 meshes with the sprocket 222 of the sprocket train 22 and meshes with the sprocket 57 through a slot 124 defined in the top portion 120 of the frame 12. By such an arrangement, the sprocket 222 is rotated with the shaft 21 by means of the motor 20 so as to rotate the sprocket 57 via the chain 232, thereby subsequently rotating the shaft 55 so as to rotate the blade 54 in the body 502.

Figure 5:
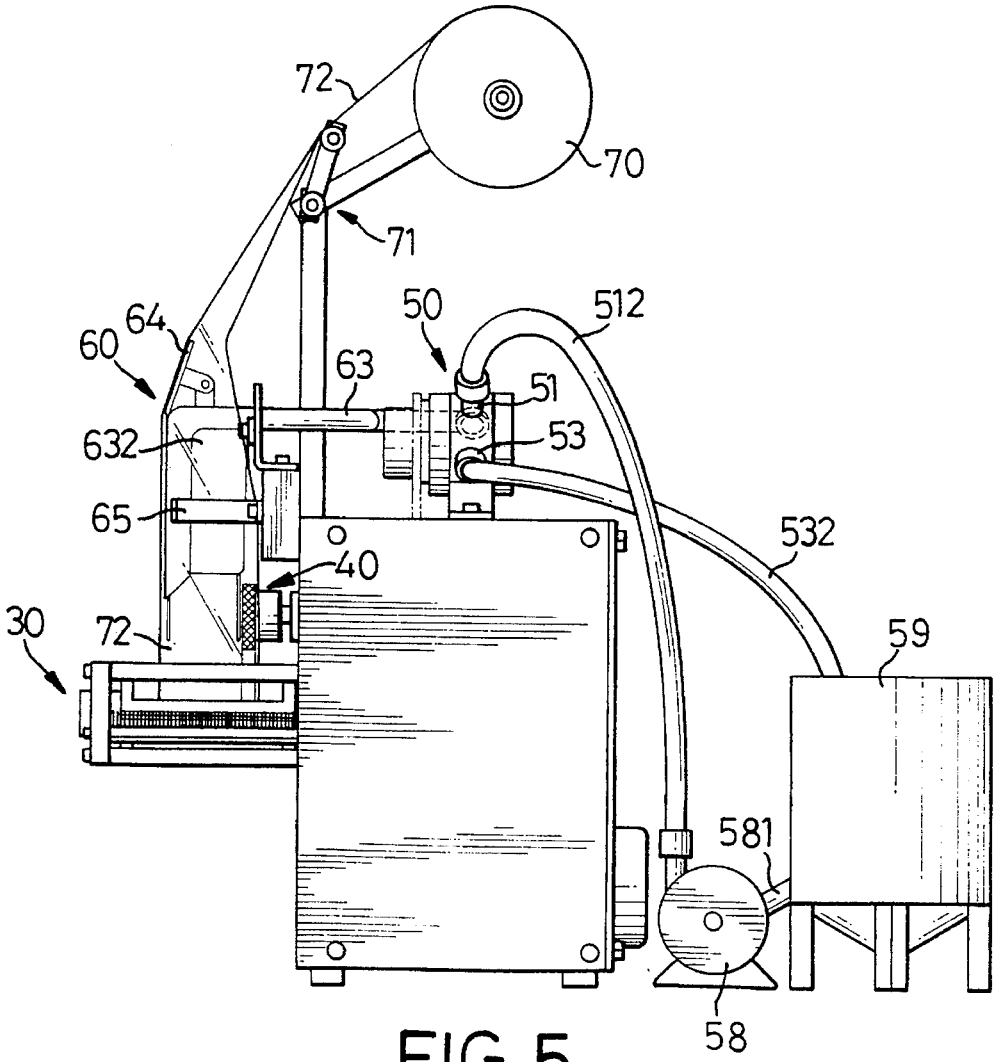
FIG. 5 is right side operational view of the packing machine.

Referring to FIGS. 1 and 5, the inlet portion 51 is connected to a tube 512 which is in turn connected to a pipe 581 which is in turn connected to a reservoir 59 in which fluid material is contained therein. A pump 58 is mounted between the tube 512 and the pipe 581 for supplying the fluid material from the reservoir 59 via the inlet portion 51 into the body 502 of the supply device 50. The fluid material supplied from the reservoir 59 into the body 502 is transferred into the outlet portion 52 via the rotary blade 54 actuated by means of the rotary shaft 55. In addition, excess fluid material is conveyed away from the body 502 via the circulating portion 53 and is then introduced into the reservoir 59 via a tube 532.

Referring to FIG. 1, the guiding device comprises a substantially L-shaped tube 63 including a horizontal portion (not labeled) connected with the outlet portion 52 of the body 502 for supplying fluid material therefrom and an upstanding portion (not labeled) located above the second sealing module 30 for impregnating the fluid material into the plastic film 72. A positioning base 61 is mounted on the side portion of the frame 12 beneath the horizontal portion of the L-shaped tube 63. Preferably, a connecting member 62 is mounted between the horizontal portion of the tube 63 and the positioning base 61 for stably supporting the tube 63. Two side plates 632 and 65 each respectively protrude outwardly from the positioning base 61 with the upstanding portion of the L-shaped tube 63 being located between the two side plates 632 and 65. A pivot base 641 is fixedly mounted on the horizontal portion of the L-shaped tube 63, and a guiding plate 64 is pivotally mounted on the pivot base 641 for smoothly guiding the plastic film 72.

In operation, referring to FIGS. 1 and 5, the plastic film 72 initially wrapped around a spool 70 is unscrolled therefrom via two guiding rods 71 and is extended to cover the guiding plate 64 and the vertical portion of the L-shaped tube 63. The plastic film 72 is then smoothly introduced by means of the guiding plate 64 together with the vertical portion of the tube 63 to move downwardly with the two opposite edges of the plastic film 72 being respectively retained by the two side plates 632 and 65 so as to be smoothly pressed into a slit 402 defined between the two sealing rollers 41 and 42, thereby being sealed and coupled together by means of the two sealing rollers 41 and 42 which are rotated relative each other.

The plastic film 72 with two opposite edges being sealed is subsequently displaced downwardly to be pressed into a slit 302 defined between the two elongated plates 31 and 32 which are both in a horizontal status such that the bottom end of the plastic film 72 is sealed by means of the two elongated plates. The fluid material contained in the body 502 of the supply device 50 is then introduced via the tube 63 into the plastic film 72 whose two opposite edges and bottom end are sealed.

The plastic film 72 full of fluid material is further displaced downwardly to be received in an opening (not shown) which is defined between the two elongated plates 31 and 32 when the two elongated plates 31 and 32 rotated relative to each other are both in a vertical status (not shown). The top end of the plastic film 72 is sealed by the two elongated plates 31 and 32 when the two elongated plates 31 and 32 rotated relative to each other are again in a horizontal status, thereby accomplishing packing process of the plastic film 72 which contains the fluid material therein.

It should be clear to those skilled in the art that further embodiments of the present invention may be made without departing from the teachings of the present invention.

I claim:

1. A packing machine for packing a plastic film which includes a top end, a bottom end and two opposite edges, said packing machine comprising:

a frame having a top portion, a bottom portion and a side portion;

a motor mounted on said bottom portion of said frame and including a rotary shaft laterally protruding therefrom;

a sprocket train securely mounted around said rotary shaft of said motor to rotate therewith;

a chain train mounted in said frame and meshing with said sprocket train for co-operating therewith;

a first sealing module mounted on the side portion of said frame and driven by means of said chain train for coupling said top opposite edges of said plastic film together;

a second sealing module mounted on the side portion of said frame below said first sealing module and driven by means of said chain train for sealing the bottom end of said plastic film;

a guiding device mounted on the side portion of said frame for introducing said plastic film to smoothly move through said first sealing module and said second sealing module said guiding device including a substantially L-shaped tube having a horizontal portion located above the top portion of said frame and an upstanding portion located above said second sealing module, a positioning base mounted on the side portion of said frame beneath the horizontal portion of said L-shaped tube, two side plates mounted on and protruding outwardly from said positioning base, the upstanding portion of said L-shaped tube being located between said two side plates, a pivot base fixedly mounted on the horizontal portion of said L-shaped tube, and a guiding plate pivotally mounted on said pivot base for guiding said plastic film; and a supply device mounted on the top portion of said frame and having fluid material contained therein for supplying said fluid material into said plastic film whose two opposite edges and bottom end are respectively sealed by said first and second sealing modules said supply device including a body fixedly mounted on the top portion of said frame, and an outlet portion formed on and protruding outwardly from said body and connected with the horizontal portion of said L-shaped tube.

2. The packing machine in accordance with claim 1, wherein said first sealing module comprises a first axle and a second axle each respectively mounted through the side portion of said frame and each having a first end and a second end, a first sealing roller and a second sealing roller each respectively mounted around the first end of said first and second axles and to rotate therewith, a first gear and a second gear meshing with each other and each respectively mounted around the second end of said first and second axles and to rotate therewith, a first sprocket fixedly mounted around a mediate portion of said first axle, said sprocket train comprising a second sprocket fixedly mounted around said rotary shaft of said motor, and said chain train comprising a chain meshing with said second sprocket and said first sprocket.

* * * * *